US010290990B2

(12) United States Patent
Horiuchi et al.

(10) Patent No.: US 10,290,990 B2
(45) Date of Patent: May 14, 2019

(54) METHOD FOR MANUFACTURING FEMALE TERMINAL AND FEMALE TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kanji Horiuchi, Mie (JP); Yoshitomo Tsujii, Mie (JP); Atsushi Okuda, Mie (JP); Noriyuki Uematu, Mie (JP); Kensaku Takata, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/559,443

(22) PCT Filed: Mar. 7, 2016

(86) PCT No.: PCT/JP2016/056945
§ 371 (c)(1),
(2) Date: Sep. 19, 2017

(87) PCT Pub. No.: WO2016/147927
PCT Pub. Date: Sep. 22, 2016

(65) Prior Publication Data

US 2018/0090900 A1 Mar. 29, 2018

(30) Foreign Application Priority Data

Mar. 19, 2015 (JP) ..... 2015-055924

(51) Int. Cl.
*H01R 13/187* (2006.01)
*H01R 11/22* (2006.01)
(Continued)

(52) U.S. Cl.
CPC ..... *H01R 43/16* (2013.01); *H01R 4/4809* (2013.01); *H01R 13/11* (2013.01); *H01R 13/115* (2013.01); *H01R 43/0221* (2013.01)

(58) Field of Classification Search
CPC ..... H01R 13/052; H01R 13/187
(Continued)

(56) References Cited

U.S. PATENT DOCUMENTS 5,658,175 A * 8/1997 Muzslay ..... H01R 13/111 29/874
6,899,571 B1 * 5/2005 Koch ..... H01R 4/4881 439/843
(Continued)

FOREIGN PATENT DOCUMENTS

JP 4-147580 5/1992
JP 6-20736 1/1994
(Continued)

OTHER PUBLICATIONS

International Search Report dated May 17, 2016.

*Primary Examiner* — Abdullah A Riyami
*Assistant Examiner* — Thang H Nguyen
(74) *Attorney, Agent, or Firm* — Gerald E. Hespos; Michael J. Porco; Matthew T. Hespos

(57) ABSTRACT

A method for manufacturing a female terminal (1) with a tubular portion (11) formed by bending a metal plate into a tubular shape and resilient contact pieces (12) extending from the tubular portion (11) in an axial direction of the tubular portion (11), folded inwardly of the tubular portion (11) and configured to resiliently contact a mating terminal
(Continued)

inside the tubular portion (11) includes a joining step of joining metal members thinner than the metal plate to the metal plate, and a forming step of bending the metal members joined to the metal plate and forming the metal members as the resilient contact pieces.

13 Claims, 6 Drawing Sheets

(51) Int. Cl.

| | |
|---|---|
| ***H01R 13/11*** | (2006.01) |
| ***H01R 43/16*** | (2006.01) |
| ***H01R 13/115*** | (2006.01) |
| ***H01R 4/48*** | (2006.01) |
| ***H01R 43/02*** | (2006.01) |

(58) Field of Classification Search
USPC ..... 439/843, 851, 852
See application file for complete search history.

(56) References Cited

U.S. PATENT DOCUMENTS 8,992,270 B2 * 3/2015 Glick ..... H01R 13/18 439/839
9,413,094 B2 * 8/2016 Qi ..... H01R 13/113
2001/0014560 A1 * 8/2001 Daugherty ..... H01R 13/111 439/851
2003/0068931 A1 * 4/2003 Swearingen ..... H01R 4/4881 439/843
2003/0077950 A1 * 4/2003 Swearingen ..... H01R 4/4881 439/843
2004/0003498 A1 * 1/2004 Swearingen ..... H01R 13/187 29/862
2005/0227551 A1 * 10/2005 Tabata ..... H01R 13/113 439/852
2012/0238118 A1 * 9/2012 Yoshida ..... H01R 12/57 439/259
2013/0052866 A1 * 2/2013 Ii ..... H01R 13/6581 439/607.41
2015/0126076 A1 * 5/2015 Horiuchi ..... H01R 13/111 439/691
2016/0134030 A1 * 5/2016 Ohkubo ..... H01R 13/04 439/877
2016/0226171 A1 * 8/2016 Yoshioka ..... H01R 13/187
2016/0254633 A1 * 9/2016 Miyakawa ..... H01R 43/16 439/843
2016/0285187 A1 * 9/2016 Oba ..... H01R 4/023

FOREIGN PATENT DOCUMENTS

JP 2013-62230 4/2013
JP 2014-7021 1/2014
JP 2014-89810 5/2014

* cited by examiner

METHOD FOR MANUFACTURING FEMALE TERMINAL AND FEMALE TERMINAL

BACKGROUND

Field of the Invention

The invention relates to a female terminal.

Description of the Related Art

Japanese Unexamined Patent Publication No. H04-147580 discloses a female terminal of a connector used in an electric vehicle. The female terminal includes a tubular portion and a resilient contact piece that resiliently contacts a mating terminal inside the tubular portion.

The female terminal described in Japanese Unexamined Patent Publication No. H04-147580 is formed by press-working one metal plate, and a resilient contact piece is provided with resiliency by being folded into a U shape.

An increased plate thickness for the tubular portion results in decreased electrical resistance, improved electrical conductivity and a smaller temperature increase so that a temperature increasing performance is improved. However, an increased plate thickness for the tubular portion results in an increased thickness for the resilient contact piece, and therefore the entire female terminal is enlarged.

Reducing a plate thickness of the resilient contact piece relative to a plate thickness of the tubular portion would enable the female terminal to be reduced in size while improving both electrical conductivity and a temperature increasing performance. A thickness of the resilient contact piece could be reduced by press-working and thinning a corresponding part of the metal plate before being formed as a female terminal. However, a resilient contact piece that is thinned by press-working may have a reduced strength.

A technique for thinning a resilient contact piece while suppressing a reduction in the strength of the resilient contact piece is disclosed in this specification.

SUMMARY

A method is provided for manufacturing a female terminal with a tubular portion formed by bending a metal plate into a tubular shape and also with a resilient contact piece extending in an axial direction of the tubular portion. The resilient contact piece is folded into the tubular portion and is configured to resiliently contact a mating terminal inside the tubular portion. The method includes providing a metal member that is thinner than the metal plate, joining the metal member to the metal plate, bending the metal member joined to the metal plate and forming the metal member into a specified shape to define the resilient contact piece.

The metal member is a long plate that is thinner than the metal plate and need not be subjected to press working and thinning. Thus, the resilient contact piece is strong, as compared to the method that forms a female terminal from one metal plate having a uniform thickness and then performs press working to thin a part of this metal plate that will form the resilient contact piece. Thus, according to the above manufacturing method, the resilient contact piece can be thinned while suppressing a reduction in the strength of the resilient contact piece.

The metal member may be joined to the metal plate by welding. Welding is generally low in cost. Thus, the cost for thinning the resilient contact piece can be reduced while a reduction in the strength of the resilient contact piece is suppressed.

The metal member may be joined to the metal plate by caulking. Caulking is generally low in cost. Thus, the cost for thinning the resilient contact piece can be reduced while a reduction in the strength of the resilient contact piece is suppressed.

The manufacturing method may include pressing and thinning a part of the metal plate to which the metal member is to be joined. The pressing step may be performed before the joining step. If, for example, the metal member is joined to a surface of the metal plate that becomes an outer surface of the metal plate without thinning the part to which the metal member is to be joined, then the female terminal is enlarged by a plate thickness of the metal member. Further, if the metal member is joined to a surface of the metal plate that becomes an inner surface of the metal plate, then an inner diameter of the tubular portion has to be increased to ensure a clearance between the resilient contact piece and the mating terminal and the female terminal is enlarged. However, according to the above-described manufacturing method, the part of the metal plate to which the metal member is to be joined is pressed and thinned. Thus, the enlargement of the female terminal can be suppressed.

The metal member may be joined to a surface of the metal plate that becomes the outer surface of the tubular portion If the metal member is joined to the surface of the metal plate that becomes the inner surface of the tubular portion, then the inner diameter of the tubular portion has to be increased to ensure a clearance between the resilient contact piece and the mating terminal. Thus, the female terminal is enlarged. However, the inner diameter of the tubular portion need not be increased if the metal member is joined to the surface that becomes the outer surface of the tubular portion. Thus, the female terminal can be smaller than if the metal member is joined to the surface that becomes the inner surface.

The manufacturing method may include a stamping step of stamping a flat metal plate using a die to form the metal plate, and the metal member may be joined to the metal plate using a joining apparatus provided in the die. According to this manufacturing method, the stamping step and the joining step can be performed in the die. Thus, the productivity of the method can be improved.

The invention also relates to female terminal that includes a tubular portion formed by bending a metal plate into a tubular shape. A resilient contact piece is joined to the tubular portion, extends from the tubular portion in an axial direction of the tubular portion, is folded into the tubular portion and is configured to resiliently contact a mating terminal inside the tubular portion. A plate thickness of the resilient contact piece is smaller than that of the tubular portion. Accordingly, the resilient contact piece can be thinned while a reduction in the strength of the resilient contact piece is suppressed.

According to the invention, the resilient contact piece can be thinned while a reduction in the strength of the resilient contact piece is suppressed.

DETAILED DESCRIPTION

A first embodiment is described with reference to FIGS. 1 to 3. In the following description, a front-rear direction is based on a front-rear direction shown in FIG. 1.

Figure 1:
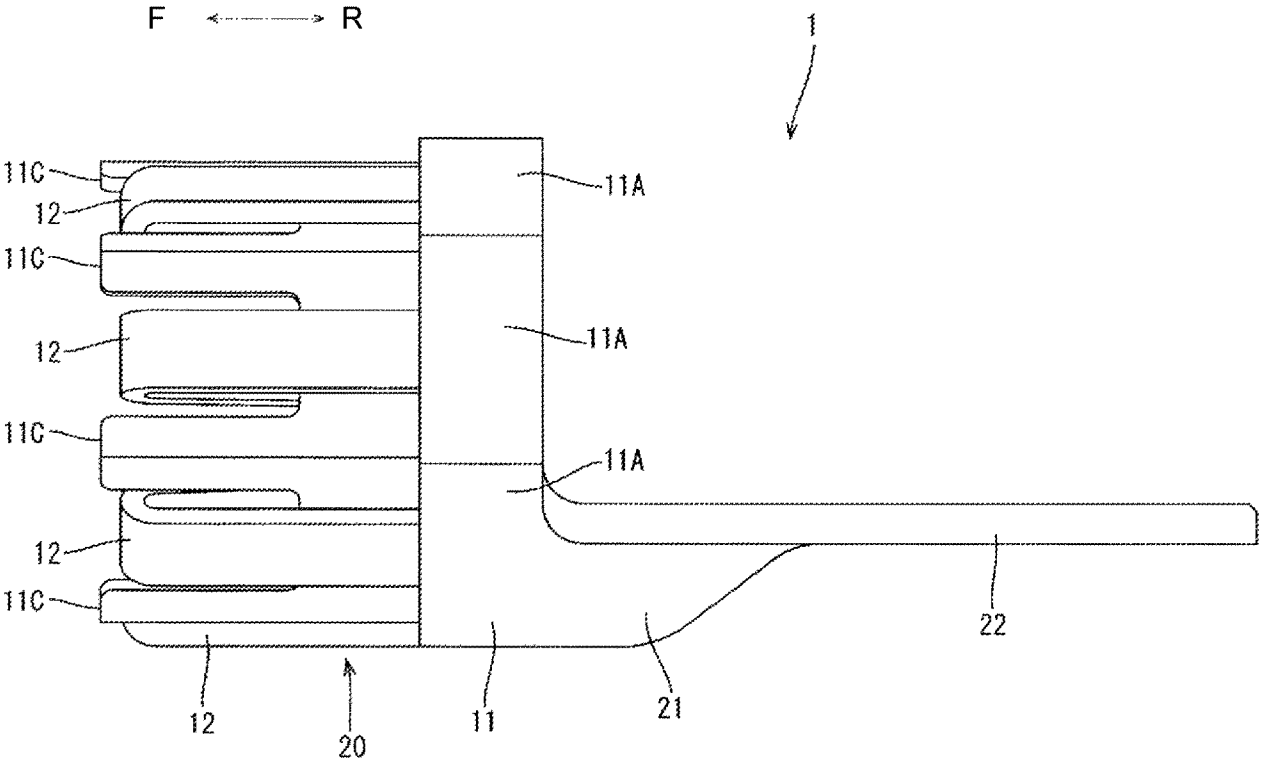
FIG. 1 is a side view of a multi-contact terminal according to a first embodiment.
Figure 2:
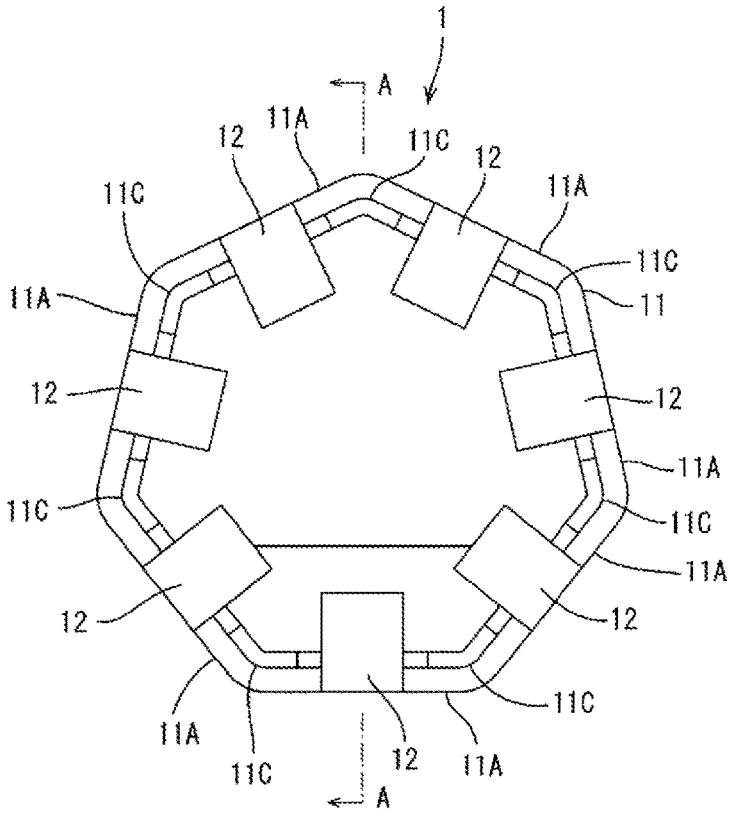
FIG. 2 is a front view of the multi-contact terminal viewed from front.

A multi-contact terminal 1 as a female terminal according to the first embodiment is illustrated in FIGS. 1 and 2. The multi-contact terminal 1 is a large current terminal used, for example, in a power supply line of an electric vehicle, hybrid vehicle or the like.

The multi-contact terminal 1 includes a polygonal tube 11 having a heptagonal tube shape and seven leaf springs 12. An unillustrated male terminal in the form of a round bar is inserted into the tube 11 from the front. When the male terminal is inserted, the seven leaf springs 12 resiliently contact the outer peripheral surface of the male terminal inside the tube 11 and the male terminal and the multi-contact terminal 1 are connected electrically. The tube 11 is an example of a tubular portion. The leaf spring 12 is an example of a resilient contact piece. Further, the male terminal is an example of a mating terminal.

(1) Configuration of Multi-Contact Terminal

As shown in FIG. 1, the multi-contact terminal 1 has a body 20 and a wire connecting portion 22 connected one after the other via a link 21.

The body 20 includes the tube 11 and the seven leaf springs 12 described above. The seven leaf springs 12 are joined to the tube 11 by welding.

The tube 11 is formed into a heptagonal tube shape by bending a metal plate. Although not shown, a square locking piece is formed on one side of the tube 11 in a bending direction to extend from this one side in the bending direction. On the other hand, a locking projection is formed by cutting and raising the other side of the tube 11 in the bending direction and projects out. After the tube 11 is bent into a heptagonal tube shape, the opening of the tube 11 is prevented by somewhat bending the locking piece to fit externally on the locking projection.

The seven leaf springs 12 extend forward in an axial direction of the tube 11 from the front opening edges of side walls 11A of the tube 11. As shown in FIG. 3, each leaf spring 12 is folded inwardly of the tube 11 into a U shape after extending forward. A section of each leaf spring 12 folded inward extends obliquely in toward the rear and is bent at a tip part to extend obliquely out. A part of each leaf spring 12 bulging most inward (bent part) defines a contact portion configured to contact the male terminal.

The seven leaf springs 12 are shaped identically to have the same length, width, bent shape and the like. Further, each leaf spring 12 is narrower than the respective side wall.

As described above, the leaf springs 12 are joined to the tube 11 by welding. Specifically, as shown in FIG. 3, a front opening edge of the rectangular tube 11 is formed into a thin portion 11B by having an outer surface recessed inward roughly by an amount corresponding to a plate thickness of the leaf springs 12 as compared to the outer surface of the other part of the tube 11. The leaf springs 12 are joined to the outer surface of the thin portion 11B by laser welding.

Figure 3:
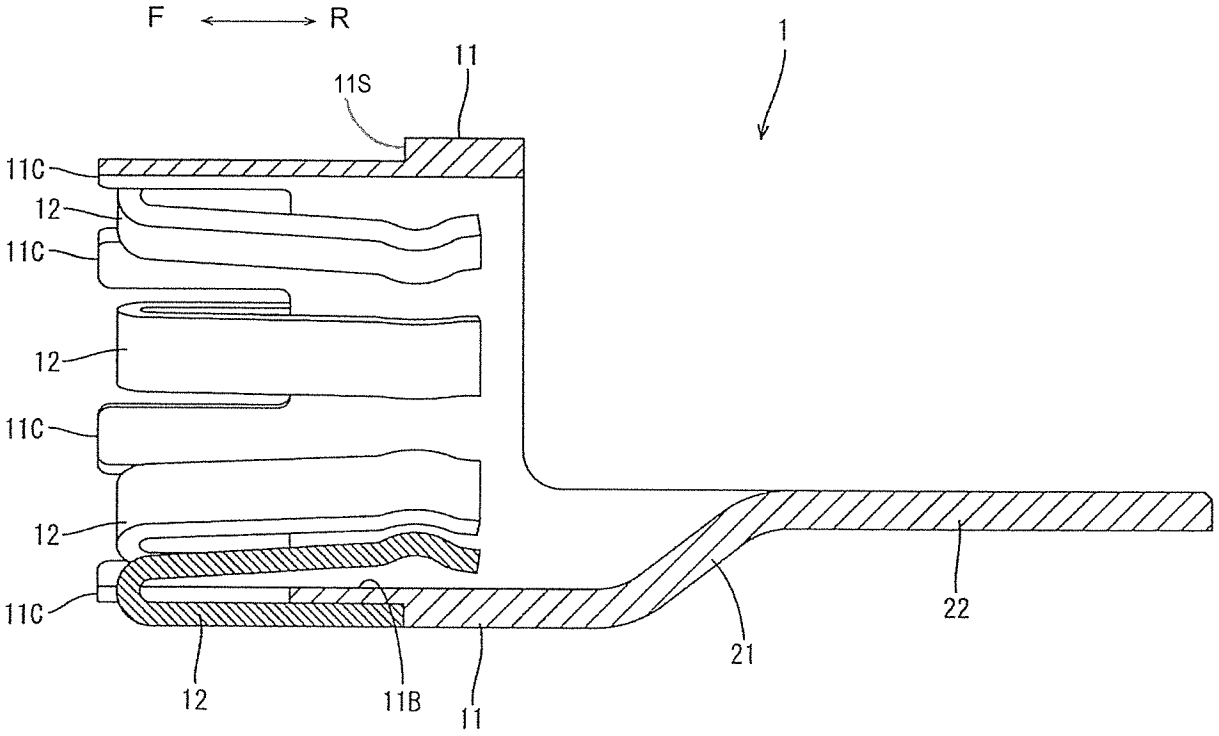
FIG. 3 is a section along A-A of FIG. 2 of the multi-contact terminal.

Further, as shown in FIG. 3, the plate thickness of the leaf springs 12 is smaller than that of the tube 11 (i.e. plate thickness of the metal plate). Here, the plate thickness of the tube 11 means a plate thickness of a thickest part of the tube 11. Specifically, since the plate thickness of the part of the tube 11 other than the thin portion 11B is larger than the plate thickness of the thin portion 11B, the part other than the thin portion 11B is the thickest part. That is, in this embodiment, the plate thickness of the leaf springs 12 is smaller than that of the part of the tube 11 other than the thin portion 11B.]

As shown in FIG. 1, extending portions 11C are provided between adjacent ones of the leaf springs 12 on the front opening edge part of the tube 11 and extend forward. A plate thickness of the extending portions 11C is equal to that of the thin portion 11B. The tube 11 is formed into a heptagonal tube shape by being bent in the bending direction at these extending portions 11C. As shown in FIG. 1, the front ends of the leaf springs 12 are located behind front ends of the extending portions 11C.

The linking portion 21 extends rearward from the rear end edges of three successive side walls 11A out of the seven side walls 11A of the tube 11.

The wire connecting portion 22 extends rearward from the rear end edge of the link 21. An unillustrated wire is welded to the wire connecting portion 22.

(2) Manufacturing Process of Multi-Contact Terminal

In a manufacturing process of the multi-contact terminal 1, a flat metal plate of uniform thickness is formed by stamping with a die to form a shape corresponding to the shape of the rectangular tube 11 (stamping step).

Subsequently, a part of the metal plate corresponding to the front end of the tube 11 is thinned by a press apparatus to form the thin portion 11B described above (pressing step). The thin portion 11B forms a forwardly facing step 11S adjacent to the area of the tube 11 that is not thinned.

Subsequently, a laser welding apparatus is used to laser weld long plate-shaped metal members to the outer surface of the thin portion 11B of the metal plate that were formed in the pressing step (joining step). In this way, the metal members are joined to the metal plate. The laser welding apparatus is an example of a joining apparatus.

Note that the pressing apparatus used in the pressing step described above and the laser welding apparatus used in the joining step may be incorporated into the die used in the stamping step. In such a case, the flat metal plate and the metal members are set in the die and the flat metal plate is stamped by the die to form the metal plate. Then, the part of that metal plate corresponding to the front opening edge part of the tube 11 is thinned by the press apparatus provided in the die and, thereafter, the metal members are laser-welded to the metal plate by the laser welding apparatus provided in the die.

Subsequently, the metal members joined by the joining step are bent by the press apparatus to form the leaf springs 12 (forming step).

Subsequently, the press apparatus bends a part of the metal plate corresponding to the link 21 to form the link 21, and the press apparatus further bends the metal plate in the bending direction at positions corresponding to the extending portions 11C to form the tube 11 (tube forming step).

(3) Effects of Embodiment

According to the method for manufacturing the multi-contact terminal 1 according to the first embodiment described above, the metal members thinner than the metal plate are joined to the metal plate and are bent to be formed as the leaf springs 12. Thus, a reduction in the strength of the leaf springs 12 can be suppressed as compared to the case where a multi-contact terminal is formed from one metal plate having a uniform thickness, with parts of the metal plate to be formed as leaf springs being press-worked and thinned, and with the thinned parts then being bent to form the leaf springs. Therefore, according to the manufacturing method of the first embodiment, the leaf springs 12 can be thinned while a reduction in the strength of the leaf springs 12 is suppressed.

Further, according to the manufacturing method of the first embodiment, the metal members are laser-welded to the metal plate in the joining step. Thus, the cost for thinning the leaf springs 12 can be reduced while a reduction in the strength of the leaf springs 12 is suppressed as compared to the case where an irregular cross section material is used. This is specifically described below.

A method for thinning the leaf springs 12 while suppressing a reduction in the strength of the leaf springs 12 is possibly a method for forming the leaf springs 12 and the tube 11 from one metal plate from an irregular cross section material where parts to be formed as the leaf springs 12 are thinned in advance. The irregular cross section material mentioned here means a material in which the parts to be formed as the leaf springs 12 are thinned, without depending on press working, such as by cutting the parts to be formed as the leaf springs 12 or by casting a material using a mold such that the parts to be formed as the leaf springs 12 are thin.

Generally, the cost of joining metal members to a metal plate by laser welding is lower than cost of using an irregular cross section material. Thus, if the metal members are joined to the metal plate by laser welding, the cost for thinning the leaf springs 12 can be reduced while a reduction in the strength of the leaf springs 12 is suppressed as compared to the case where the irregular cross section material is used.

The manufacturing method according to the first embodiment includes the pressing step of forming the metal plate with the thin portion 11B before the joining step. For example, if the metal members are joined to a surface of the metal plate that becomes the outer surface of the tube 11, without forming the thin portion 11B, the multi-contact terminal 1 is enlarged by the plate thickness of the metal members. Further, if the metal members are joined to a surface of the metal plate that becomes the inner surface of the tube 11, an inner diameter of the tubular portion has to be increased to ensure a clearance between the leaf springs 12 and the mating terminal and the multi-contact terminal 1 is enlarged. If the thin portion 11B is formed, the enlargement of the multi-contact terminal 1 can be suppressed.

Further, according to the manufacturing method of the first embodiment, the metal members are joined in the joining step to the surface of the metal plate that becomes the outer surface of the tube 11. If the metal members are joined to the surface of the metal plate that becomes the inner surface of the tube 11, an inner diameter of the tube 11 has to be increased to ensure the clearance between the leaf springs 12 and the mating terminal. Thus, the multi-contact terminal 1 is enlarged. If the metal members are joined to the surface of the metal plate that becomes the outer surface of the tube 11, the inner diameter of the tube 11 need not be increased. Thus, the enlargement of the multi-contact terminal 1 can be suppressed as compared to the case where the metal members are joined to the surface that becomes the inner surface.

Further, the stamping step and the joining step can be performed in the die according to the manufacturing method of the first embodiment, thereby improving the productivity of the manufacturing method.

Further, according to the multi-contact terminal 1 of the first embodiment, the leaf springs 12 can be thinned while suppressing a reduction in the strength of the leaf springs 12

A second embodiment is described with reference to FIGS. 4 and 5.

In a multi-contact terminal 201 according to the second embodiment, leaf springs 12 are joined to a polygonal tube 11 not by laser welding, but by caulking.

Figure 4:
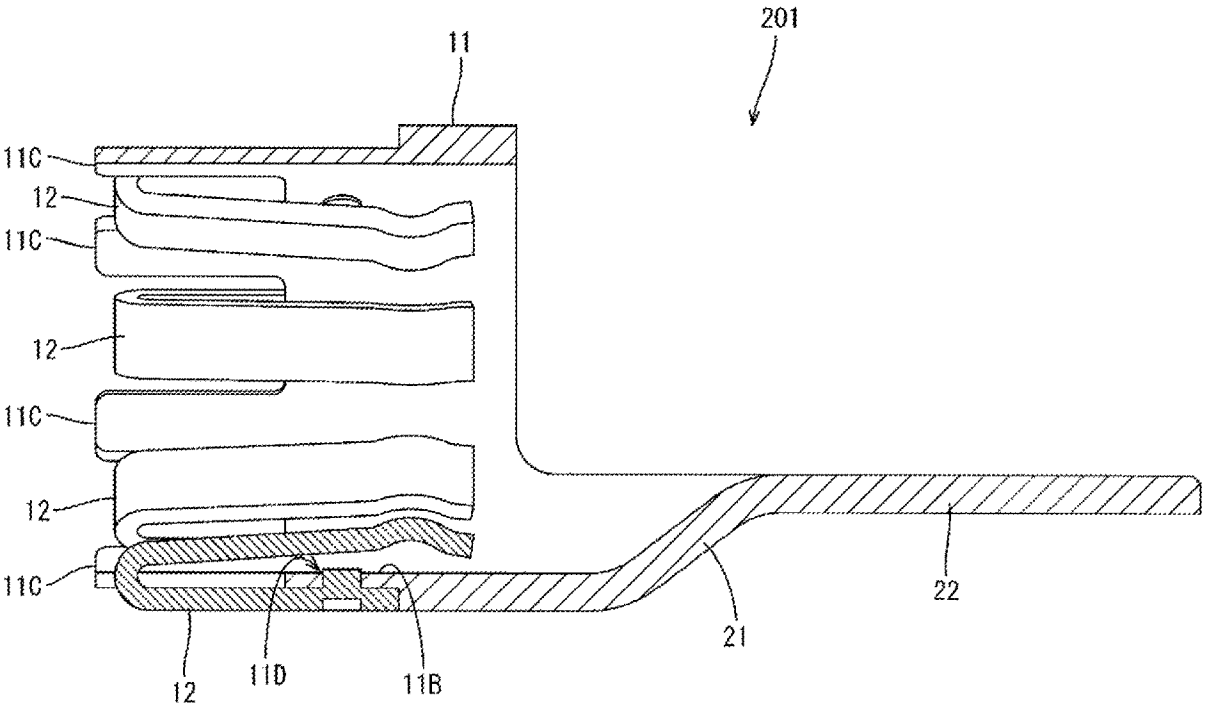
FIG. 4 is a section of a multi-contact terminal according to a second embodiment.
Figure 5:
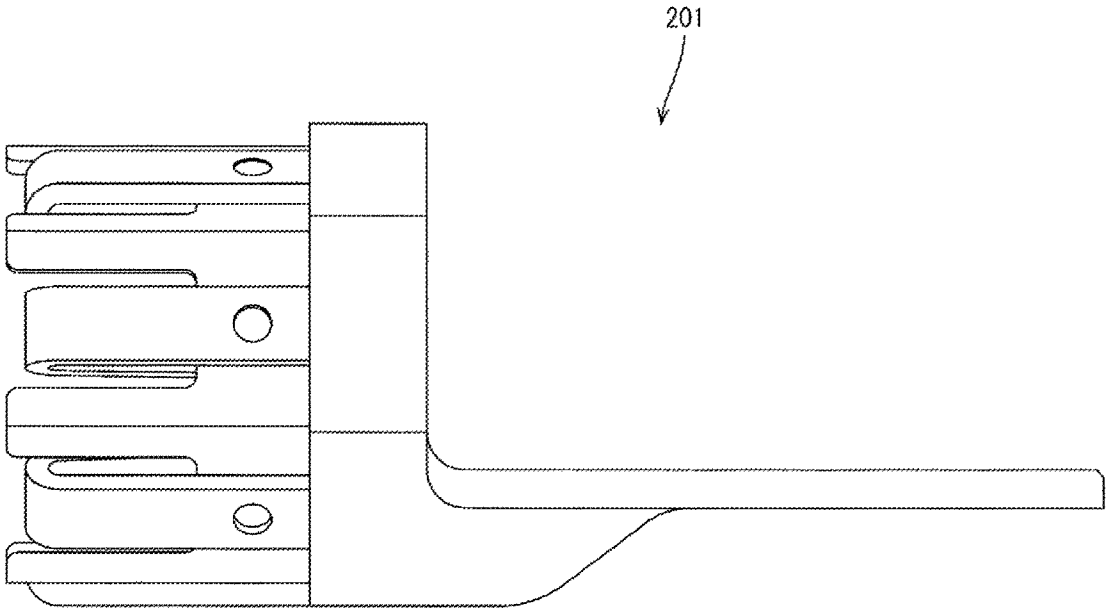
FIG. 5 is a side view of the multi-contact terminal.

As shown in FIG. 4, a thin portion 11B of a metal plate according to the second embodiment is formed with circular through holes 11D penetrating in a plate thickness direction. As shown in FIG. 4, metal members in the form of long plates to be formed as the leaf springs 12 are pressed circularly at positions corresponding to the through holes 11D from an outer surface by a press apparatus in a joining step according to the second embodiment (see FIG. 5).

As shown in FIG. 4, when the metal members are pressed by the press apparatus, materials of the metal members enter the through holes 11D of the thin portion 11B and the thin portion 11B is caulked from inner sides of the through holes 1D by the materials that have entered. In this way, the metal members are joined to the metal plate.

The second embodiment is substantially the same as the first embodiment in other respects.

According to the multi-contact terminal 201 of the second embodiment, the metal members are joined to the metal plate by caulking. Generally, the cost of joining metal members to a metal plate by caulking is lower than cost of using an irregular cross section material. Thus, if the metal members are joined to the metal plate by caulking, the cost for thinning the leaf springs 12 can be reduced while a reduction in the strength of the leaf springs 12 is suppressed as compared to the case where the irregular cross section material is used.

The invention is not limited to the above described and illustrated embodiments. For example, the following embodiments also are included in the scope of this specification.

Figure 6:
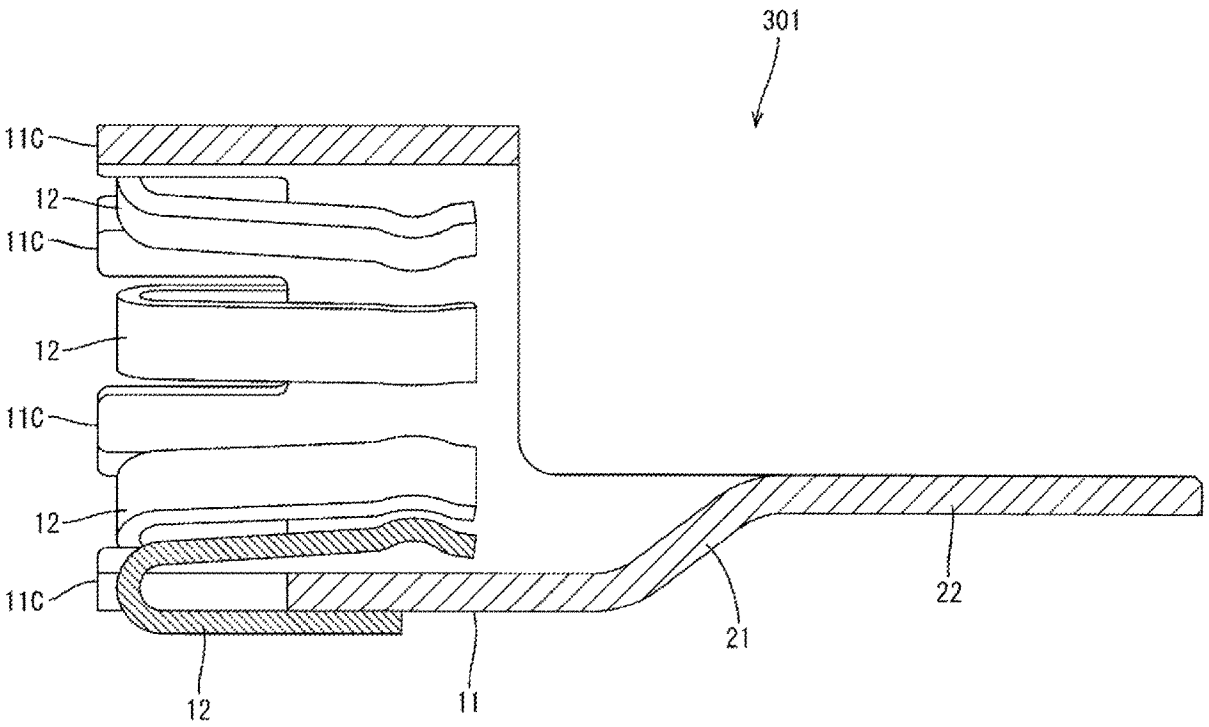
FIG. 6 is a section of a multi-contact terminal according to another embodiment.

A case where the metal plate is formed with the thin portion 11B and the metal members are joined to that thin portion 11B is illustrated in the first embodiment. In contrast, the metal members may be joined without forming the metal plate with the thin portion 11B as in a multi-contact terminal 301 shown in FIG. 6. The same holds true for the second embodiment.

A case where the metal members are joined to the metal plate by laser welding is illustrated in the above first embodiment. However, welding is not limited to laser welding and can be performed by an arbitrary method.

Further, although a case where the metal members are joined to the metal plate by welding is illustrated in the first embodiment, joining may be performed by a known technique such as soldering or brazing, may be performed by crimping or may be performed using a conductive adhesive. However, a method is desirably able to reduce manufacturing cost as compared to the case where an irregular cross section material is used.

A case where the metal plate is formed with the through holes 11D and the metal members are caulked by causing the materials thereof to enter the through holes 11D of the metal plate is illustrated in the second embodiment. Contrary to this, the metal members may be formed with through holes and caulked by causing the material of the metal plate to enter the through holes of the metal members.

Further, the caulking method is not limited to the method described in the second embodiment and caulking can be performed by an arbitrary method.

A case where the metal members are joined to the surface of the metal plate that becomes the outer surface of the tube 11 is illustrated in the above embodiments. In contrast, the metal members may be joined to the surface of the metal plate that becomes the inner surface of the tube 11.

Although the multi-contact terminal including seven resilient contact pieces is illustrated as a female terminal in the above embodiments, the number of the resilient contact pieces is not limited to seven.

LIST OF REFERENCE SIGNS

1 . . . multi-contact terminal (female terminal)
11 . . . rectangular tube portion (tubular portion)
12 . . . leaf spring (resilient contact piece)
201 . . . multi-contact terminal (female terminal)
301 . . . multi-contact terminal (female terminal)

The invention claimed is:

1. A method for manufacturing a female terminal from a metal plate, the metal plate having opposite front and rear ends and opposite first and second surfaces defining a plate thickness, the method comprising the steps of:

a pressing step of pressing the first surface of the metal plate at areas of the metal plate adjacent the front end to define a reduced plate thickness of the front end that is smaller than the plate thickness of areas of the metal plate adjacent the rear end;

a joining step of joining at least one metal member to the first surface of the metal plate at areas adjacent the front end of the metal plate, the at least one metal member having a metal member thickness smaller than the plate thickness of the metal plate and having a projecting front end region projecting forward of the front end of the metal plate;

a forming step of bending the projecting front end region of the at least one metal member toward the rear end of the metal plate to form at least one resilient contact piece that faces the second surface of the metal plate; and a tube forming step of bending the metal plate to form a tube, with the second surface of the metal plate facing inward on the tube and with an axis of the tube extending between the front and rear ends.

2. The method of claim 1, wherein the metal member is joined to the metal plate by welding in the joining step.

3. The method of claim 1, wherein the metal member is joined to the metal plate by caulking in the joining step.

4. The method claim 1, further comprising a stamping step of stamping a flat metal plate using a die to form the metal plate, wherein the metal member is joined to the metal plate using a joining apparatus provided in the die in the joining step.

5. The method of claim 1, wherein a forwardly facing step is formed on an outer surface of the metal plate between the front and rear ends during the pressing step.

6. The method of claim 1, wherein the reduced plate thickness and the metal member thickness define a combined thickness equal to the plate thickness of the metal plate.

7. A female terminal, comprising:

a tube having opposite front and rear ends and opposite inner and outer surfaces, areas of the outer surface of the tube adjacent the front end of the tube being pressed inward toward the inner surface of the tube to define a reduced thickness area, the tube having a first plate thickness at the reduced thickness area and a second plate thickness rearward of the rearward of the reduced thickness area, the second thickness being larger than the first thickness; and resilient contact pieces joined to the outer surface of the tube at the reduced thickness area, the resilient contact pieces being folded inwardly of the tube and extending in an axial direction of the tube towards the rear end, the resilient contact pieces being configured to resiliently contact a mating terminal inside the tube, and each of the resilient contact pieces having a resilient contact piece plate thickness smaller than the second plate thickness of the tube.

8. The female terminal of claim 7, further comprising a welded connection between the tube and the at least one resilient contact piece.

9. The female terminal of claim 7, further comprising a caulked connection between the tube and the at least one resilient contact piece.

10. The female terminal of claim 7, wherein a forwardly facing step is formed on the outer surface of the tube at a rear end of the reduced thickness area.

11. The female terminal of claim 7, wherein the first plate thickness and the resilient contact piece thickness define a combined thickness equal to the second plate thickness.

12. The female terminal of claim 7, wherein the tube is polygonal in a cross-section perpendicular to an axis extending between the front and rear ends of the tube.

13. The female terminal of claim 7, wherein areas of the tube between the resilient contact pieces defining extending portions project more forward than the resilient contact pieces.

* * * * *